United States Patent [19]

Mattei et al.

[11] Patent Number: 4,631,900

[45] Date of Patent: Dec. 30, 1986

[54] METHOD FOR PACKING BATCHES OF PRODUCTS, PACKETS OR BOXES IN CARTONS DIVISIBLE INTO SEVERAL COMPLETE UNITS

[75] Inventors: Riccardo Mattei; Giancarlo De Martis, both of Bologna, Italy

[73] Assignee: G.D. Societa per Azioni, Bologna, Italy

[21] Appl. No.: 706,862

[22] Filed: Feb. 28, 1985

[30] Foreign Application Priority Data

Mar. 30, 1984 [IT] Italy ..... 3405 A/84

[51] Int. Cl.[4] ..... B65B 35/30; B65B 11/48

[52] U.S. Cl. ..... 53/448; 53/449; 53/462

[58] Field of Search ..... 53/443, 448, 449, 462, 53/416

[56] References Cited

U.S. PATENT DOCUMENTS 2,651,153 9/1953 Burnett ..... 53/445 X
4,263,769 4/1981 Hanazawa et al. ..... 53/448

FOREIGN PATENT DOCUMENTS 363893 12/1931 United Kingdom .
477651 1/1938 United Kingdom .
490148 8/1938 United Kingdom .

*Primary Examiner*—Horace M. Culver
*Attorney, Agent, or Firm*—Cushman, Darby & Cushman

[57] ABSTRACT

Disclosed herein is a method for packing at least two independent batches of products, arranged identically one after the other, using two cuttings of wrapping material, namely one per batch, at least one of which provided with at least one external tag or flap that stays projecting with respect to one of the sides of the wrap created with the said cutting, and for producing a complete carton by stably restraining one to the other, the said batches of products wrapped in the said cuttings, using as the element for firmly connecting one to the other, the said tag or flap, this being glued to the facing surface of the wrap resting on the side from which the said tag or flap projects.

4 Claims, 11 Drawing Figures

METHOD FOR PACKING BATCHES OF PRODUCTS, PACKETS OR BOXES IN CARTONS DIVISIBLE INTO SEVERAL COMPLETE UNITS

BACKGROUND OF THE INVENTION

The invention relates to the packing of products in cartons and, in particular, to the packing of packets of cigarettes, of the soft cup or rigid type, in cartons.

DESCRIPTION OF THE PRIOR ART

As is known, various operational stages are envisaged in the packing of cigarettes and these, commencing with a mass of cut tobacco, make it possible to produce cartons of cigarettes in packets placed side by side, wherein there are generally ten or twenty packets.

For the implementation of the said stages, provision is made essentially in a cigarette packing plant for:

- machines in which the cigarettes are produced one by one and are subjected to a soundness check;
- machines that packet the cigarettes, forming the cigarettes into a predetermined number (customarily ten or twenty) and attending to the wrapping thereof in one or more sheets of wrapping material for protection against external agents;
- machines that carton the packets of cigarettes, forming the cartons generally out of ten or twenty packets, arranging the packets in groups of five (one at the side of the other), and wrapping the said products in soft paper or in cardboard boxes; this gives rise to the package known on the market with the term "carton".

The plant can be provided with other machines, such as, for example, machines that fit a filter to the cigarette, cellophaning machines for overwrapping the individual packets of cigarettes and machines for parcelling cartons of cigarettes. It is pointless to go deeply into the composition of the plants since the invention concerns one specific operating stage in the packing of cigarettes and, more precisely, relates to the stage in respect of the production of the said carton as defined above.

The cartons are made up, as previously stated, of a given number of packets of cigarettes wrapped in soft paper or in a cardboard box. Both are normally produced with the use of flat cuttings of wrapping material folded around the suitably pre-arranged batches of packets. The said cuttings have on the outer surface, print publicizing the manufacturer through which the product is identified.

Prepared in this way, the carton is ready to be sold as it stands or to be opened for the individual packets of cigarettes to be sold. Once open, the carton serves solely for selling individual packets of cigarettes. It thus ensues that a lesser number of packets than that contained in a carton can be sold only by supplying loose packets or, in the case of soft material cartons, by cutting the carton empirically whenever the purchaser asks, for example, for half of the products contained therein.

When this is the case, the detached packets remain wrapped in the cut part of the carton, while the purchaser receives an open pack that is clearly not in the original condition thereof and, moreover, is ugly.

SUMMARY OF THE INVENTION

The main object of the method for packing batches of products, packets or boxes according to the invention is to remedy the problem outlined above through, for example, the possibility of having a carton of packets of cigarettes in which the total number of packets corresponds to that of conventional type cartons, though made in such a way that it be possible to divide the said carton into at least two units or batches of cigarettes, each provided with a perfectly defined and completely sealed wrap, wherein each unit contains a number of packets that is a submultiple of the total number forming the carton.

With this method, the carton can be divided into the units out of which it is composed, each of which is, in turn, constituted in practice by a fully defined carton of packets of cigarettes. In this way, for example, out of a complete carton containing ten packets of cigarettes, it is possible to obtain two complete five packet units, one of which can be opened to sell a packet or two, while the other unit remains in a perfectly sound condition.

The method according to the invention for packing products such as, in particular, packets of cigarettes in cartons comprises the following stages:

- the wrapping of at least two independent batches of products that are arranged identically one after the other, using two cuttings of wrapping material, namely one per batch, at least one of which provided with at least one external tag or flap that stays projecting with respect to one of the sides of the wrap created with the said cutting;
- the stable amalgamation of the said batches of products wrapped in the said cuttings, with the said batches being carried first into a position in which one is superposed on the other or is at the side of the other, utilizing as the support surface, the said side from which the said external tag or flap projects, and then with the said external tag or flap being used as the element for firmly connecting, one to the other, the two independent batches of wrapped products.

Advantageously the carton thus produced is provided with two tags or flaps that, projecting from the ends of one wrapped batch of products, fully cover the ends of the other batch and are fixed thereto with glue. In the said tags or flaps there is a weakening or tear line along which, exercising a manual action, the two batches of wrapped products can be torn apart.

BRIEF DESCRIPTION OF THE DRAWINGS

The characteristics of the method and of the carton forming the subject of the invention will now be outlined more amply in the description that follows of certain embodiments, with reference to the accompanying drawings, in which.

DESCRIPTION OF THE PREFERRED EMBODIMENTS

Figure 1:
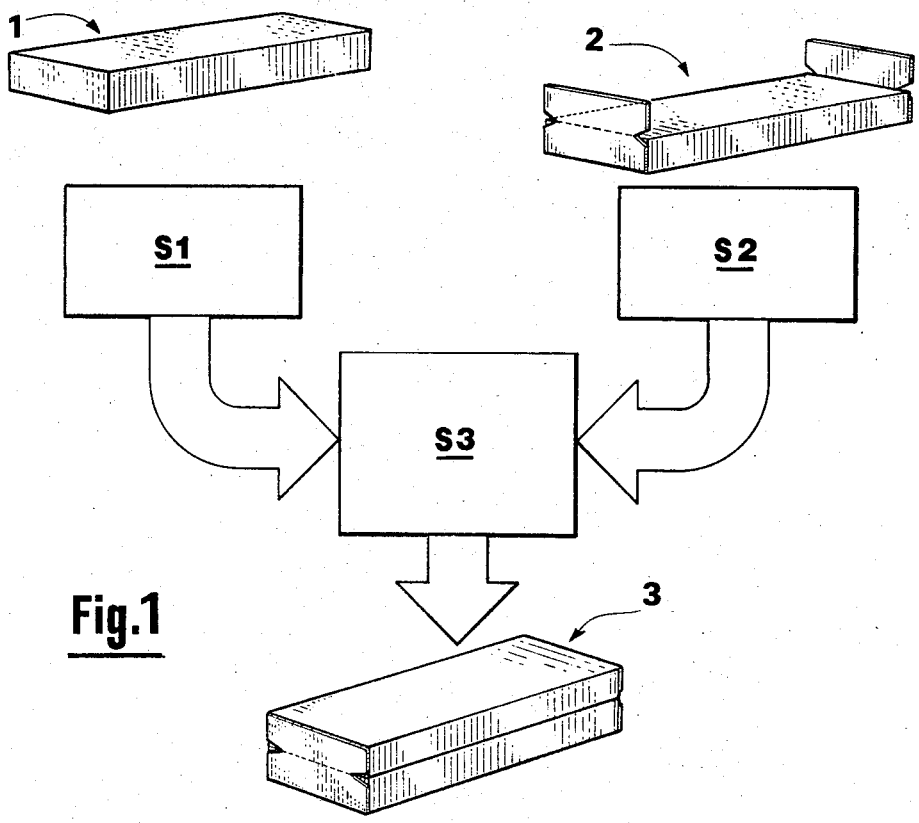
FIG. 1 shows, diagrammatically, a plant of the type that can be used to employ the method according to the invention.
Figure 2:
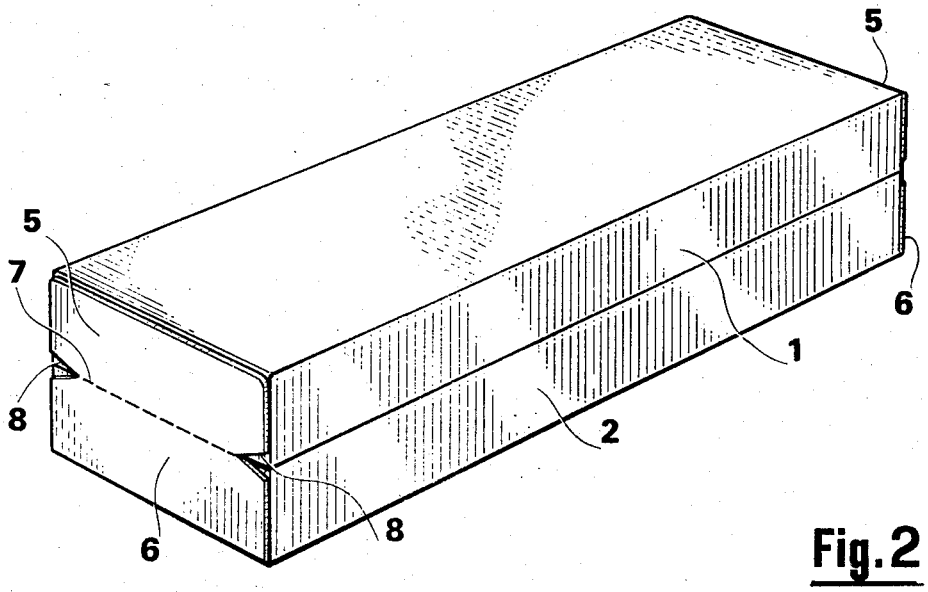
FIG. 2 shows, diagrammatically in a perspective view, a carton produced with the method in question.
Figure 3:
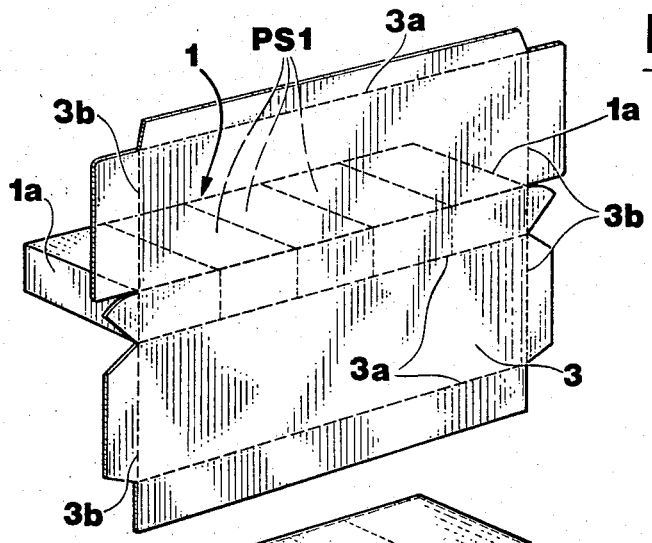
FIGS. 3, 4, 5 and 6 show, diagrammatically, the various stages in the wrapping of the two batches of products with which the carton depicted in FIG. 2 is formed.

With reference to the above listed figures and, in particular, to FIGS. 1 to 6, shown at S1 and S2 are two items of machinery that can be constituted either by two self-contained cartoners or by two output lines of one single cartoning machine provided with two lines for the delivery of batches of packets of cigarettes wrapped in a form independent of one another.

At S3 is shown a third item of machinery to which the batches 1 and 2 of packets of cigarettes issuing from the machines S1 and S2 are sent.

In machine S3 the batches 1 and 2 are positioned one next to the other, in the case illustrated through superposition, in order to exit connected, one to the other, by means of tags or flaps shown at 5, more about which will be said later on.

As can be seen in FIGS. 3 to 6, in the machine S1 a first batch 1 of five packets of cigarettes PS1, laid one at the side of the other, is wrapped completely, utilizing a sheet or cutting of wrapping material 3 (blanks can be used depending on the thickness), and this is folded mechanically around the batch 1 until the said batch is fully wrapped therein. For example, the ideal folding lines 3*a* and 3*b* define the tags or flaps destined to cover the sides and the ends 1*a*, respectively, of the batch 1.

In the machine S2 a second batch 2 of five packets of cigarettes PS2, arranged identically to the packets PS1, is wrapped utilizing a second cutting of wrapping material 4 that is also folded mechanically around the batch 2 until the said batch is fully wrapped therein. The folding of the cutting of wrapping material 4 can be effected along the ideal folding lines 4*a* and 4*b* that are similar to the ideal lines 3*a* and 3*b* for the cutting of wrapping material 3.

The cutting of wrapping material 4 is provided with two tags or flaps 5 that are external and contiguous to the tags or flaps 6 destined to cover the ends 2*a* of the batch 2. The said tags or flaps 5 are of an area sufficient to cover the ends 1*a* of the batch 1 and, with the batch 2 wrapped, they both project from the major amplitude side 2*b* of the said batch 2. Shown at 7 are weakening or tear lines which, in practice, ideally separate the tags or flaps 5 from the tags or flaps 6 at the height of the edge of the side 2*b*. Provided in the region of the said weakening lines are wedge shaped indentations 8 that assist the commencement of the tearing of the tags or flaps 5 along the lines 7.

Figure 4:
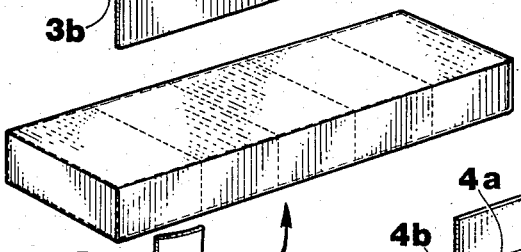
Figure 5:
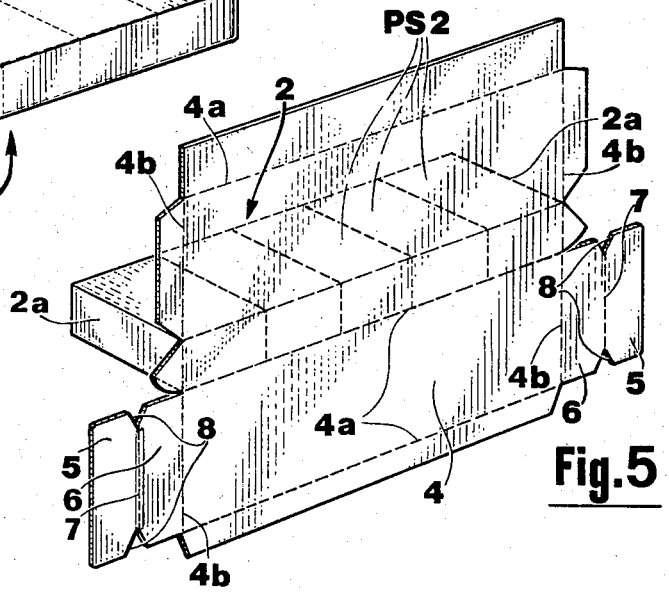
Figure 6:
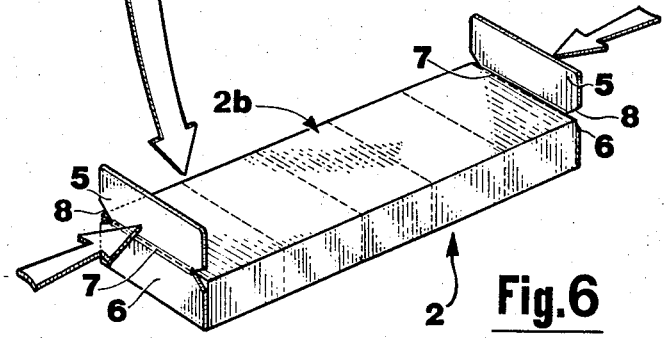

In machine S3 a batch of products 1, wrapped as illustrated in FIG. 4, and a batch of products 2, wrapped as illustrated in FIG. 6, are carried into the mutual approach condition, with the batch 1 superposed on the batch 2, resting on the side 2*b* of this, and with the ends 1*a* placed in between the tags or flaps 5. The said tags or flaps are secured to the ends 1*a* through gluing operations in such a way that the end product takes the form, when exiting from the the machine S3, of one single carton divisible along the weakening lines 7 into two units.

Figure 7:
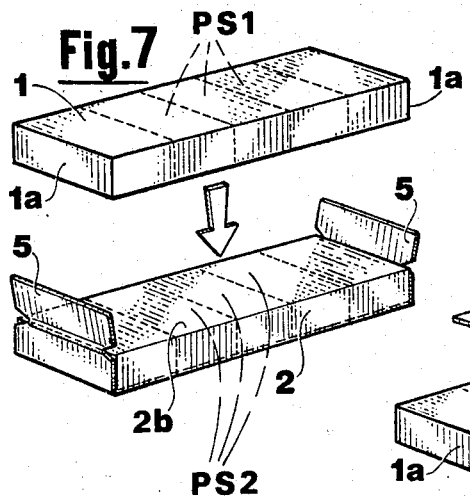
FIGS. 7, 8, 9, 10 and 11 show, diagrammatically, various stages in the fitting together of the two batches of wrapped products in order to form, in turn, the final pack or carton composed of two independent units.
Figure 8:
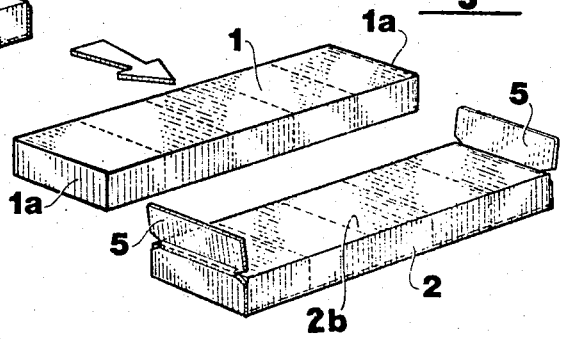

The approach of the batches 1 and 2 (see FIGS. 7 and 8) can take place with movement of the batch 1 towards the batch 2 in a direction perpendicular to the side 2*b* thereof (FIG. 7) or with the batch 1 sliding onto the side 2*b* of the batch 2 (FIG. 8).

Figure 10:
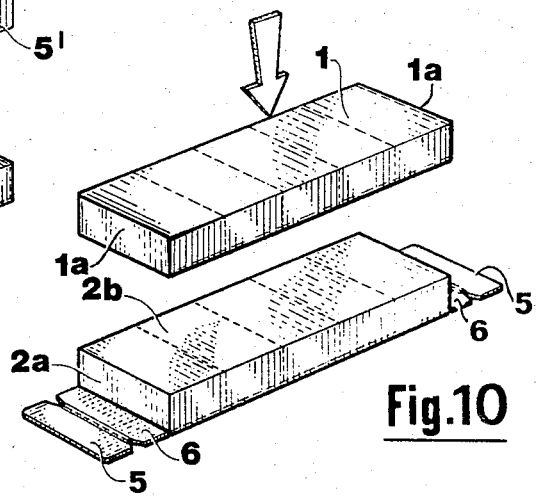

In accordance with what is illustrated in FIG. 10, the carton of products that exits from the machine S3 can be produced by feeding thereto a batch 1 of packets that is wrapped, and a batch 2 of packets that is partially wrapped, that is to say, without the tags or flaps 5 and 6 being folded.

Once the superposition of the batches 1 and 2 has been effected, the tags or flaps 6 are folded along the lines 3*b* until they are carried into covering the side 2*b*, while contemporaneously or subsequently, the tags or flaps 5 are placed in tight contact (through gluing) with the ends 1*a* of the batch 1.

Figure 9:
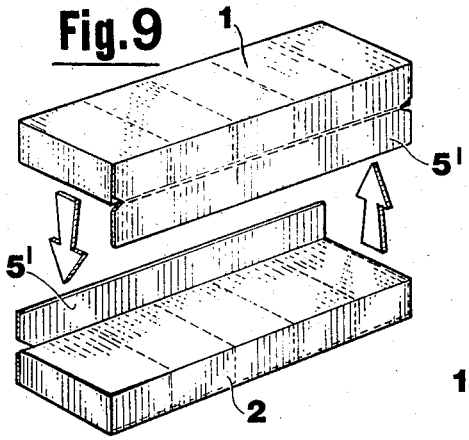
Figure 11:
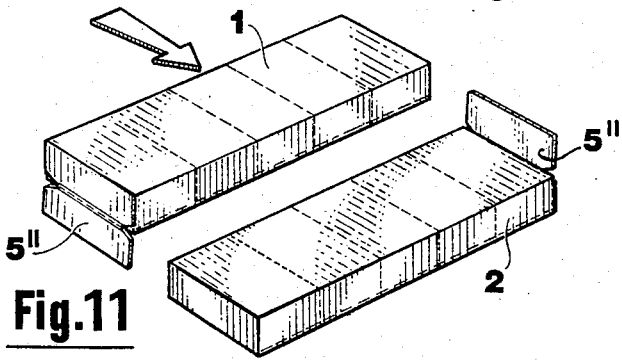

In FIGS. 9 and 11 are shown two possible variants for the packing of the batches 1 and 2, and in these the tags or flaps that act as elements of connection between the batches 1 and 2 are given the reference numbers 5' (in FIG. 9) and 5'' (in FIG. 11), respectively.

As regards FIG. 9, both the batches 1 and 2 are provided with a tag or flap 5' that extends from the tag or flap that covers one side of the said batches.

In the case of FIG. 11, both the batches 1 and 2 are provided with a tag or flap 5'' that extends from the tag or flap that covers one end of the said batches.

The superposition or approach of the batches 1 and 2 can, also in the above mentioned cases, take place with movement of one with respect to the other in the direction of the sides that rest one on the other, or through one sliding on the resting surface of the other.

Obviously, the foregoing description has been given purely by way of an example and, therefore, the invention can be realized, in the practical embodiments thereof, also with technical means differing from those outlined herein. Thus, for example, the complete carton can have the connection tags or flaps 5, or 5', or 5'', placed on different sides to those illustrated, without deviating from the framework of protection afforded to the invention as described herein and claimed hereinafter.

What is claimed is:

1. A method of forming a package of the type having at least two discrete packets where each packet has a plurality of edges and includes a plurality of individual items comprising the steps of:

arranging the items in a selected order for each packet, wrapping each packet of items with a separate sheet of flexible wrapping material, providing at least one flap of the wrapping material extending from a weakened tear line on one edge of each packet, and joining the said flap of one packet to the exterior surface of the other said packet and joining the said flap of said other packet to the exterior surface of said one packet to form said package with said flaps being remote from one another on said package.

2. The method as claimed in claim 1 including the step of disposing said flaps prior to the joining step at opposite ends of said package.

3. The method as claimed in claim 2 wherein said packets are box shaped with each having ends with a selected end constituting said exterior surface and including the step of disposing a said flap to extend from an edge of a said end.

4. A method of forming a package of the type having at least two discrete packets where each packet has a plurality of edges and includes a plurality of individual items comprising the steps of:

arranging the items in a selected order for each packet, wrapping each packet of items with a separate sheet of flexible wrapping material, providing at least one flap of the wrapping material extending from one edge of one of said packets, and joining the said flap of said one packet to the exterior surface of the other said packet to form said package.

* * * * *